US005082086A

United States Patent [19]

Kerr

[11] Patent Number: 5,082,086

[45] Date of Patent: Jan. 21, 1992

[54] WHEELED LADDER

[75] Inventor: James F. Kerr, Croswell, Mich.

[73] Assignee: Material Control, Inc., Croswell, Mich.

[21] Appl. No.: 622,760

[22] Filed: Dec. 5, 1990

[51] Int. Cl.[5] ..... E06C 1/397

[52] U.S. Cl. ..... 182/17; 182/113; 182/116

[58] Field of Search ..... 182/17, 16, 15, 116

[56] References Cited

U.S. PATENT DOCUMENTS

| | | | |
|---|---|---|---|
| 3,130,814 | 4/1964 | Aquila | 182/15 |
| 3,552,521 | 1/1971 | Tate | 182/17 |
| 3,841,437 | 10/1974 | Caughey | 182/16 |
| 4,063,616 | 12/1977 | Gutierrez | 182/17 |
| 4,442,919 | 4/1984 | Fulcher | 182/17 |

FOREIGN PATENT DOCUMENTS

| | | | |
|---|---|---|---|
| 791282 | 2/1958 | United Kingdom | 182/15 |

*Primary Examiner*—Reinaldo P. Machado
*Attorney, Agent, or Firm*—Dykema Gossett

[57] ABSTRACT

A ladder is disclosed including wheels normally received off the ground, and four legs normally supporting the ladder. When it is desired to move the ladder, it is pivoted off the legs until the wheels contact the ground and fully support the ladder. The ladder may then be moved. A rail includes an angled portion which provides a handle allowing the ladder to be easily moved. The wheel is most preferably mounted above the ground by a distance between its radius and its diameter such that when the ladder is supported on the wheels, the legs will not interfere with the ground.

3 Claims, 1 Drawing Sheet

WHEELED LADDER

BACKGROUND OF THE INVENTION

This application relates to an improved ladder having wheels normally received off the ground, but which may be pivoted to a position such that the wheel contacts the ground for easy transport.

Ladders are known in the prior art in which wheels are spring biased into the ground. If weight is received on these ladders, support legs are forced downward to contact the ground and the ladder is firmly supported. Thus, when a user stands on these ladders, the legs are biased into the ground to support the ladder.

Problems arise with these prior art ladders since the biased wheels may sometimes give a user the impression that the ladder is not sturdy. This is of course undesirable.

It is an object of the present invention to disclose an easily transportable ladder. It is further an object of the present invention to disclose such a ladder in which wheels are fixed off the ground when the ladder is being used.

SUMMARY OF THE INVENTION

The present invention discloses a ladder comprising a plurality of steps at different vertical positions, and at least one wheel normally received vertically off the ground. The ladder is preferably normally supported on legs.

When it is desired to transport the ladder, it is pivoted off the legs until the wheels contact the ground. The ladder may then be moved to a new position and reset on the legs.

In a disclosed embodiment of the present invention, the ladder extends between two lateral sides. Wheels are preferably positioned at each lateral side. Further, legs are preferably positioned at each lateral side.

In a most preferred embodiment of the present invention, the ladder includes a platform, which forms a top step, and extends longitudinally from forward to rearward positions. Legs are preferably positioned at longitudinally forward and rearward positions at each lateral end. In a most preferred embodiment of the present invention, the wheels are positioned longitudinally forwardly of the legs such that the ladder may be pivoted onto the wheels and moved with the legs in the air.

In a most preferred embodiment, a rail includes a vertical portion positioned near the steps, a horizontal portion extending along the platform and an angled portion connecting the vertical and horizontal portions. When the ladder is pivoted onto the wheel for transport, the angled portion provides a handle such that a user may easily grasp and control the ladder.

In a most preferred embodiment of the present invention, the wheels are positioned a vertical distance off the ground somewhere between the radius and diameter of the wheel. With wheels positioned at this height, the ladder may be supported on the wheel, but the legs will not be extend so far forwardly that they are likely to contact the ground creating interference to movement of the ladder.

In a most preferred method according to the present invention, a ladder normally sets on legs resting on the ground and having wheels received off the ground. The ladder is pivoted off the legs until the wheels contact the ground, and the ladder is fully supported on the wheels. The ladder is then moved on the wheels to a new position and returned to rest on the legs.

A ladder according to the present invention is not supported on the wheels when in use, and the wheels are fixed to the frame. The inventive ladder is sturdy and easily movable.

These and other objects and features of the present invention are best understood from the following specification and drawings of which the following is a brief description.

DETAILED DESCRIPTION OF THE PREFERRED EMBODIMENT

Figure 1:
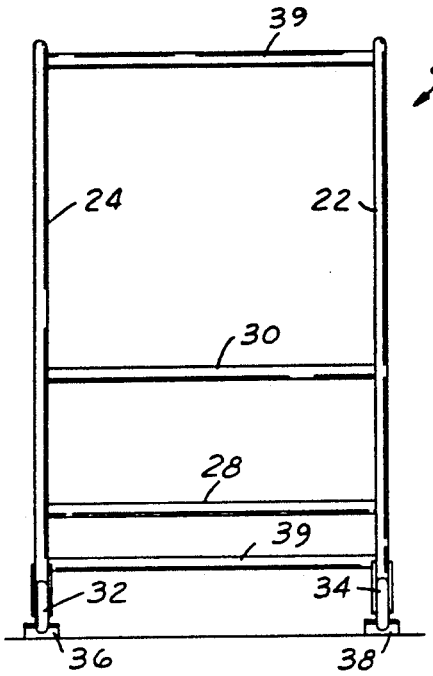
FIG. 1 is a front view of a ladder according to the present invention

A preferred embodiment of the present invention can be understood from FIG. 1-5. FIG. 1 disclose ladder 20 which includes a pair of lateral side rails 22 and 24 extending generally vertically. Step support therefore 28 leads to platform support 30 which extends longitudinally rearwardly. A planar material 31 covers both step support 28 and platform support 30.

First wheel 32 is fixed on side 24 while second wheel 34 is fixed on side 22. First leg 36 is received on lateral side 24 while second leg 38 is received on lateral side 22. Legs 36 and 38 normally support ladder 20, and wheels 32 and 34 are normally received off the ground.

Figure 2:
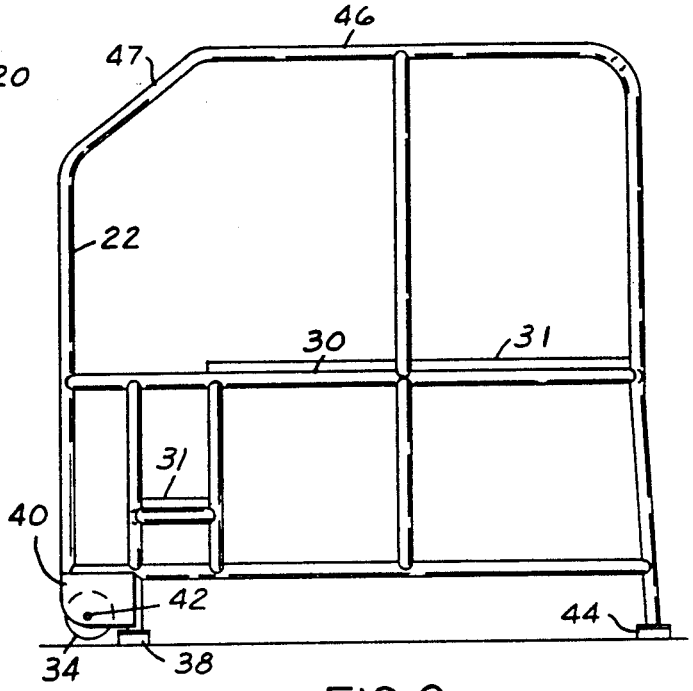
FIG. 2 is a side view of a ladder according to the present invention.

FIG. 2 illustrates wheel mount 40 to mount and vertically position wheel 34. Pin 42 fixes wheel 34 at a vertical position greater than the radius, but less than the diameter of the wheel. Legs 38 and 44 support side 22 of ladder 20, as shown. Wheel 34 is mounted longitudinally forwardly of legs 38 and 44.

As shown, side supports 22 and 24 extend vertically downwardly, but are recessed such that wheel 34 is positioned vertically beneath, and axially rearwardly of, side supports 22 and 24. Leg 38 is positioned rearwardly of wheel 34, and extends vertically downwardly from a bottom of side supports 22 and 24. Leg 38 is positioned at an axial position aligned with a front of step support 28.

A rail includes a vertically extending portion 45 mounted in the longitudinally forward portion of ladder 20 adjacent step support 28, and a horizontally extending portion 46 extending along platform support 30. Angled portion 47 connects vertical portion 45 and horizontal portion 46.

Figure 3:
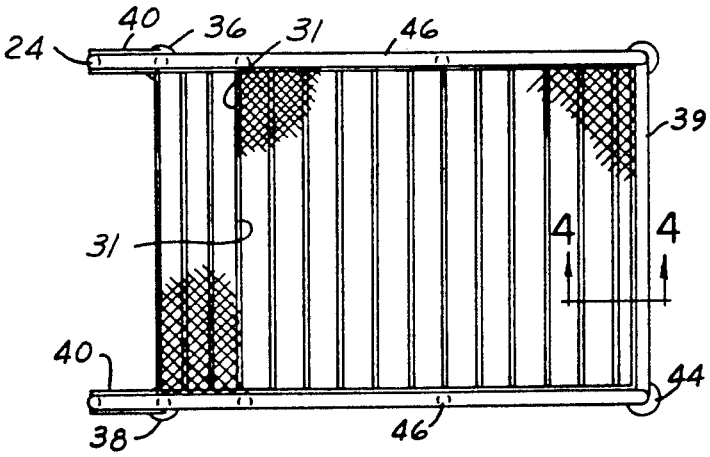
FIG. 3 is a top view of a ladder according to the present invention.

FIG. 3 is a top view of ladder 20. Platform support 30 extends longitudinally and supports material 31. Step support 28 supports step material 31. Wheel mounts 40 are fixed at each lateral end 22 and 24 of ladder 20. Legs, 36, 28, 44 and 48 support ladder 20 at each lateral end at both longitudinal ends. Rear rail 39 connects the two opposed lateral horizontal rails 46.

Figure 4:
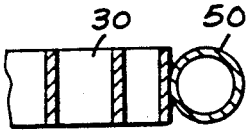
FIG. 4 is a partial cross-sectional view along line 4—4 as shown in FIG. 3.

As shown in FIG. 4, platform 30 is affixed to rail 50. Rail 50 also extends between support members at each lateral side 22 and 24 to fully support the rear portion of platform 30.

Figure 5:
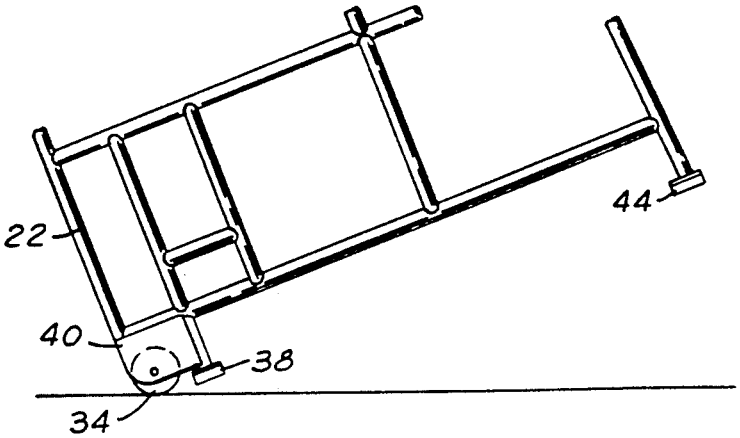
FIG. 5 is a partial side view of a ladder according to the present invention.

FIG. 5 shows ladder 20 in a transport position. The ladder 20 is pivoted off of legs 36, 38, 44 and 48 until wheels 32 and 34 contact the ground. Since wheels 32 and 34 are positioned only a small vertical distance off of the ground, legs 36 and 38 do not extend far beyond wheels 32 and 34. Thus, when ladder 20 is in this transport position, legs 36 and 38 will not interfere and contact the ground, which could cause obstruction to movement of ladder 20.

In this position, angled portion 47 extends generally vertically. Thus, this portion provides a pair of handles to allow a user to fully control ladder 20.

A method of using ladder 20 according to the present invention will now be described. Ladder 20 is supported on legs 36, 38, 44 and 48 when in a use position. When it is desired to move ladder 20, the ladder is pivoted onto wheels 32 and 34 and then moved to a new position at which it is reset on the legs.

A preferred embodiment of the present invention has been disclosed, however, a worker of ordinary skill in the art would realize that certain modifications would come within the scope of this invention and thus following claims should be studied in order to determine the true scope and content of the invention.

I claim:

1. A ladder comprising:

a frame having a first step at a first vertical position and a second step at a second vertical position above said first vertical position;

at least one wheel normally fixed at a third vertical position which is below said first vertical position, but off of the ground;

said first and second steps extend between lateral ends of said frame, and there being two of said wheels, with one positioned at each said lateral end;

legs positioned at least at each lateral end, said legs normally contacting the ground;

a rail positioned on said frame and extending generally vertically near said steps; and said wheels being positioned longitudinally forwardly of said legs, said wheels rotating about a point fixed on said frame at a position normally vertically off the ground by a distance greater than a radius of said wheels, but less than a diameter of said wheels; and wherein said vertically extending portion of said rail being positioned longitudinally forwardly of said wheels, and extending downwardly to a vertical position spaced from the ground such that a recess is defined longitudinally rearwardly and vertically beneath said rail, and longitudinally forwardly of said leg, and said wheels are disposed in said recess, said leg being longitudinally aligned with a longitudinally forwardmost portion of said first step.

2. A ladder as recited in claim 1, wherein said platform is positioned vertically above said second step, said platform extending longitudinally rearwardly from said first and second steps, there being four of said legs, with one positioned at each lateral end at both longitudinally forward and rearward positions.

3. A ladder as recited in claim 2, wherein said rail extending generally vertically near said steps and generally horizontally along said platform, an angled portion connecting said generally vertical and horizontal sections, and extending at an angle to both.

* * * * *